United States Patent [19]

Hirokawa et al.

[11] Patent Number: 4,597,158

[45] Date of Patent: Jul. 1, 1986

[54] PRESSURE CONNECTION DEVICE FOR A CONNECTOR

[75] Inventors: Haruo Hirokawa, Yokohama; Hitoshi Miyahira, Tokyo, both of Japan

[73] Assignee: Hirose Electric Co., Ltd., Tokyo, Japan

[21] Appl. No.: 502,514

[22] Filed: Jun. 9, 1983

[30] Foreign Application Priority Data

Jul. 15, 1982 [JP] Japan ..... 57-123139

[51] Int. Cl.[4] ..... H01R 43/04

[52] U.S. Cl. ..... 29/566.3; 29/749; 29/751; 29/760

[58] Field of Search ..... 29/33 M, 364.6, 749, 29/747, 566.2, 566.1, 566.3, 566.4, 751, 753, 760

[56] References Cited

U.S. PATENT DOCUMENTS

| | | | |
|---|---|---|---|
| 3,249,983 | 5/1966 | Cobaugh | 29/753 X |
| 3,845,535 | 11/1974 | Over | 29/749 |
| 3,935,628 | 2/1976 | Tucci | 29/749 |
| 4,048,710 | 9/1977 | Nigman | 29/749 X |
| 4,137,624 | 2/1979 | Davis et al. | 29/749 X |
| 4,275,945 | 6/1981 | Boutcher, Jr. et al. | 29/749 |
| 4,281,442 | 8/1981 | Senior et al. | 29/33 M |
| 4,351,110 | 9/1982 | Folk | 29/753 |

FOREIGN PATENT DOCUMENTS

| | | | |
|---|---|---|---|
| 2249592 | 4/1973 | Fed. Rep. of Germany | 29/749 |
| 2521515 | 12/1975 | Fed. Rep. of Germany | 29/749 |

*Primary Examiner*—Gil Weidenfeld
*Assistant Examiner*—Glenn L. Webb
*Attorney, Agent, or Firm*—Yuter Rosen & Dainow

[57] ABSTRACT

A pressure connecting device comprising a pressure connecting rod for squeezing cables one by one into the pressure contacts of a connector to establish electrical connection, a guide bar having a slide surface being in slidable contact with the slide surface of the pressure connecting rod and adapted to support in position the cable, whereby the cable is sheared by the rod and the guide bar before squeezing the cable into the contact of the connector. According to this construction, the cutting faces formed on the pressure connecting rod and the guide bar do not collide with each other in shearing the cable, thereby to remarkably lengthen the service life thereof. Besides, the cutting faces are equal in height to the side surface of the connector, thereby preventing the sheared end of the cable from protruding from the connector.

15 Claims, 8 Drawing Figures

PRESSURE CONNECTION DEVICE FOR A CONNECTOR

BACKGROUND OF THE INVENTION

1. Field of the Invention

This invention relates to a pressure connection device for a connector provided with a plurality of contacts in alignment and adapted to shear and squeeze electric cables into the contacts of the connector to establish electrical connection.

2. Description of the Prior Art

There has been known a pressure connection device of this type, which comprises, as illustrated in FIG. 6, a holder adapted to secure in position a connector 1 having a plurality of pressure contacts 11 in alignment, a pressure connecting rod 4 which moves toward the pressure contacts 11 of the connector 1 so as to press each electric cable 2 into the respective pressure contacts, a cutter which is moved in the direction of the contacts 11 (hereinafter, termed as "advance" or "move forward") in a state slidable on the pressure connecting rod 4, and a cutter rest 9 for supporting the cutter 8.

The aforementioned conventional pressure connection device has suffered the various drawbacks as described below.

(1) The cutter rest 9 should be formed of metallic material having strength enough to support the cable 2 to be cut and the cutting edge 81 of the cutter 8. However, the cutting edge 81 is markedly susceptible of abrasion because the cutting edge comes into collision with the cutter rest 9 immediately after shearing the cable.

(2) The positioning of the cutter 8 in relation to the cutter rest 9 is very difficult. If the side surface 91 of the cutter rest 9 is brought much too close to the side surface 15 of the connector 1, the connector is laterally energized by the cutter 8 and displaced, to thereby cause incompleteness of an electrical connection. If the distance between the side surface 15 of the connector and the side surface 91 of the cutter rest 9 is enlarged, the cutter rest fails to securely support the cutter edge 81, with the result that the cutter becomes dull and renders the precise shearing of the cable difficult. Thus, the provision of the cutter 8 and the cutter rest 9 is also difficult.

(3) Even if the slide surface 82 of the cutter 8 assumes its position lower than the surface 15 of the connector 1 in order to prevent the cutter edge 81 from causing damage on the side surface 15 or the connecting surface 12 of the connector, the cable 2 becomes possessed of a sheared edge protruding outwardly from the surface 15 thereof when it is sheared by the aforementioned cutter. Because the protruding end of the cable is tangible, the connector of this construction incurs danger and has a possibility that an irregular operation will occur in an electric device using this connector. Even if an attempt is made at using a covering case to eliminate the aforementioned disadvantage, the sheared end protruding from the side surface 15 of the connector prevents the covering case from being mounted on the connector, and consequently, it is impossible to shield the sheared end of the cable.

(4) In the case of a small-sized connector, the front surface 41 of the pressure connecting rod 4 cannot acquire ample area on which the cable 2 is supported, thereby making it impossible to secure the cable. As a result, only the cable core within the cable is drawn and slips out of place in shearing the cable, thereby frequently causing imcomplete electrical connection of the cable to the contacts of the connector. Particularly, when the cutter becomes dull, this disadvantage becomes conspicuous.

(5) The replacement or polishing of a worn-out cutter is often required because the cutter edge 81 is easily worn. In addition, every time the cutter is removed, therefore, troublesome positioning work for the cutter 8 is necessary.

SUMMARY OF THE INVENTION

An object of the present invention is to provide a pressure connection device for a connector, which is so designed that provision of a cutter rest is unnecessary, the troublesome replacement or polishing of the cutter is infrequently required and the cable can be precisely sheared so as to locate the sheared edge thereof at the desirable position.

To accomplish the object described above according to the present invention, there is provided a pressure connection device for a connector having a plurality of pressure contacts, which comprises a holder for retaining in position the connector, a guide bar adapted to guide and hold at least one cable, and a pressure connecting rod adapted to force the cable into pressure contact with the aforementioned connector.

The guide bar and the pressure connecting rod are in contact with each other in a longitudinally slidable state and move together toward the pressure contacts of the connector. In the front portion of the guide bar is formed a guide slit for guiding and supporting the cable. The slide surface of the pressure connecting rod, which is in face contact with the guide bar serves as a cutting face for shearing off the cable within the guide slit of the guide bar by the slide motion of the pressure connection rod in relation to the guide bar. The guide bar and the pressure connecting rod are so arranged that the front end surface of the pressure connecting rod is first located at its initial position behind the guide slit formed in the guide bar, and subsequently, the front end surface of the pressure connecting rod is advanced from the initial position toward the cable supported within the guide slit in the guide bar by using a driving device to thereby cause the cable to be sheared in preparation for a subsequent pressure connection, and further pressed forward to force the sheared end of the cable into the corresponding pressure contact, thereby establishing an electrical connection between the cable and the contact, and thereafter, the pressure connecting rod is returned to the initial position by using a reversing device.

DESCRIPTION OF THE PREFERRED EMBODIMENTS

Figure 1:
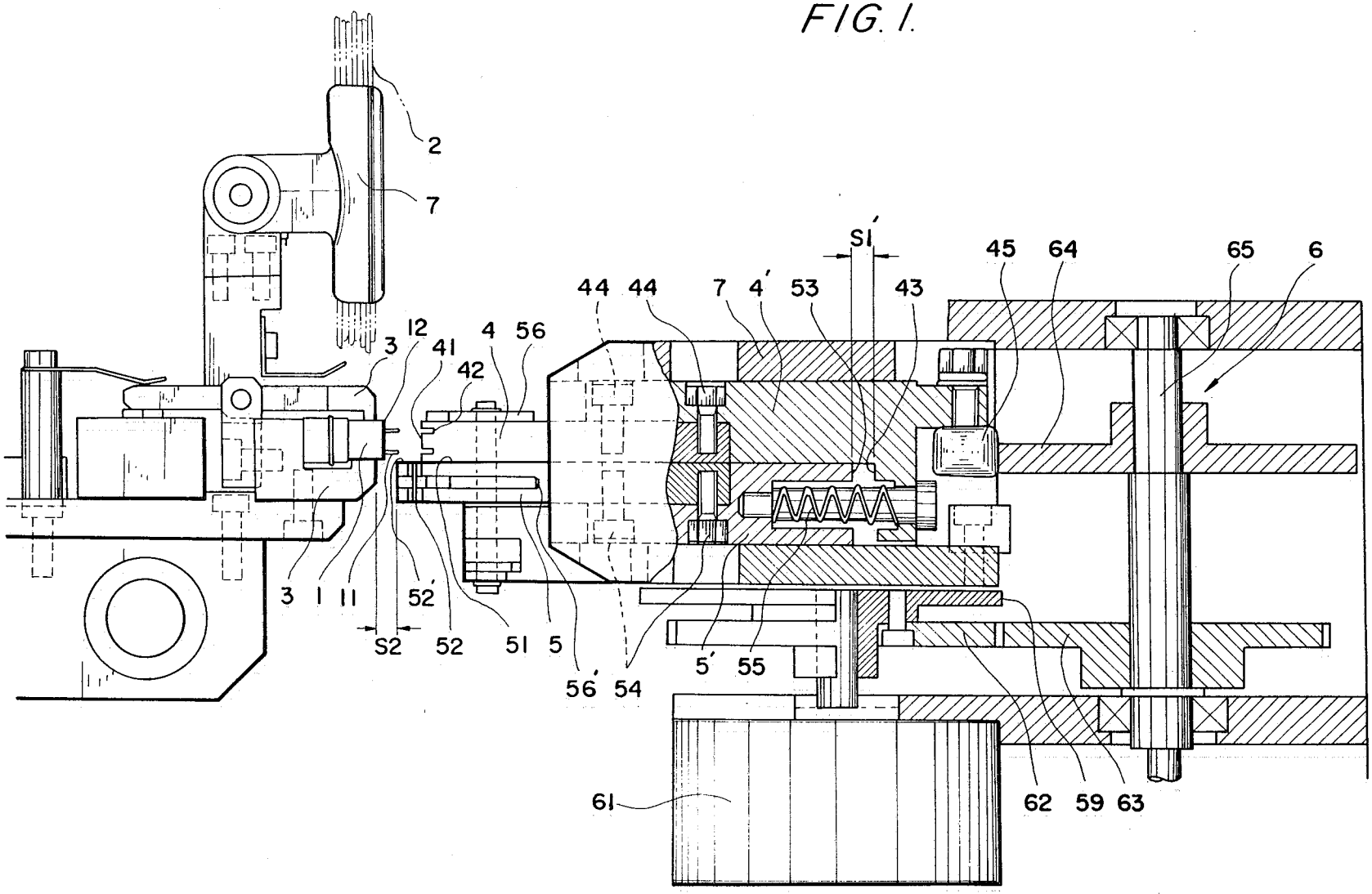
FIG. 1 is a front view illustrating in partial section a pressure connection device of one embodiment according to the present invention.
Figure 2:
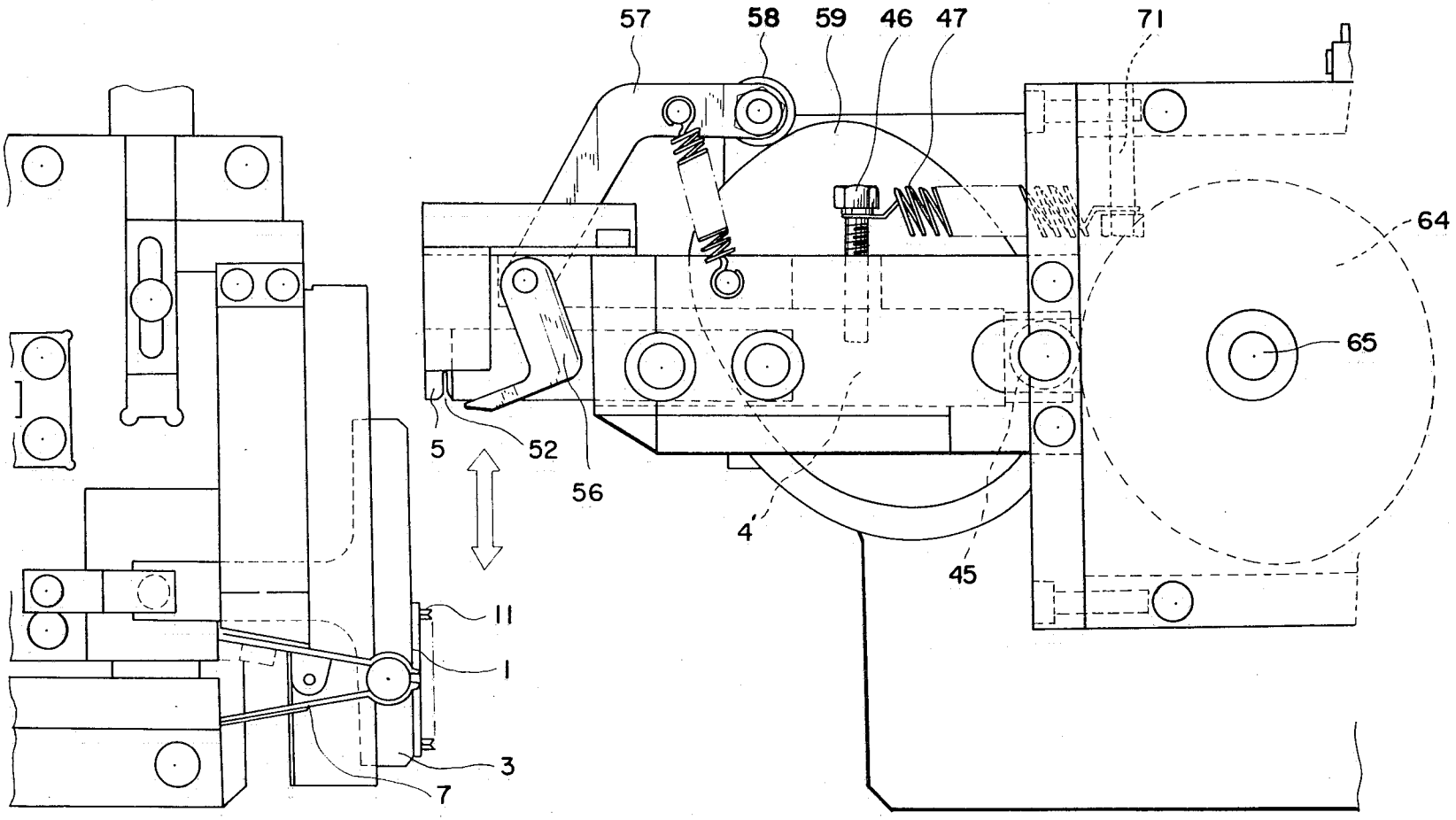
FIG. 2 is a plan view of the same.

The first embodiment of the present invention will be described with reference to FIGS. 1 through 3. The pressure connection device of this embodiment comprises a holder 3 for retaining in position a connector 1 having a plurality of pressure contacts 11, a pressure connecting rod 4 adapted to force a cable 2 into the corresponding pressure contact 11 of the connector 1 so as to squeeze the cable into the contact, and a guide bar 5 for guiding and supporting the cable 2 in preparation for pressure connection.

The aforementioned holder 3 serves to secure the connector 1 in such a state that the part on which the pressure contacts 11 are disposed protrudes toward the pressure connecting rod 4 described below. Above the holder 3 is disposed a clamping means 7 adapted to hold a plurlaity of cables in a bundle in preparation for a pressure connection.

The pressure connecting rod 4 is disposed opposite the connecting surface 12 provided with the pressure contacts 11 of the connector 1 secured by the holder 3. The pressure connecting rod 4 is possessed of a front end surface 41 facing the connecting surface 12 of the connector 1 and is mounted within a housing 7 in a state movable between the initial standby position and the position at which the front end surface 41 thereof comes into close or near-close contact with the connecting surface 12. The front end surface 41 of the pressure connecting rod 4 has escape recesses 42 which are adapted to receive the pressure contacts 11 when the front end surface 41 is close to the connecting surface 12 of the connector. On the rear portion of the pressure connecting rod 4 is fixedly provided an extruding member 4' by use of bolts 44. The push member 4' is provided with a cam follower 45 through which driving motion brought about by a driving means 6 is transmitted to the pressure connecting rod 4 so as to move the rod 4 forwardly. To allow the pressure connecting rod 4 to return to the initial position, a pulling spring 47 is disposed between a bolt 46 fixed on the extruding member 4 and a bolt 71 fixed on a base portion so as to draw back the extruding member 4.

Further, the pressure connecting rod 4 is formed in its front end surface 41 with a cable supporting groove 48 adapted to support the cable 2 so as not to come off the cable from the predetermined position of the front end surface.

The aforementioned guide bar 5 has a slide surface 51 which is brought into slidable contact with a slide surface 49 of the pressure connecting rod 4 and possessed of the front portion 52'''. The guide bar 5 is fixedly connected at its rear portions to a coupling member 5' by means of a bolt 54 or the like. The rear half of the guide bar 5 and the coupling member 5' together are contained within the housing 7 in a state movable forwardly and backwardly similarly to the pressure connecting rod 4 and the push member 4'. The coupling member 5' is provided at its rear end with a restricting surface 53 which is opposite to and separated from the stepped portion 43 of the push member 4' by the distance $S_1'$ equal to or longer than a fixed distance $S_1$ necessary for cable-shearing and complete pressure connecting works as described afterward. Between the coupling member 5' and the push member 4' is disposed a compression spring 55 adapted to exert an energizing force on the members 4' and 5'.

The guide bar 5 is driven by a cam mechanism through the medium of the cam follower 45 as described below and moved forward in concert with the pressure connecting rod by the force of the compression spring 55 until the front end surface 52'' of the guide bar 5 comes in touch with the holder 3. Though the guide bar 5 is stopped when it comes into contact with the holder 3, the pressure connecting rod 4 still moves forward against the energizing force of the compression spring 55 because of the space $S_1'$ between the restricting surface 53 of the coupling member 5' and the stepped portion 43 of the push member 4'. When a cam 64 is rotated to the extent of the maximum interval between the axes of the cam 64 and the cam follower 45, the space $S_1$ between the push member 4' and the coupling member 5' becomes minimum, and at that time, the pressure connecting rod 4 reaches its most advanced position thereby causing the cable to be sheared and forced into the pressure contact 11 to establish an electrical connection.

The slide surface 51 of the guide bar 5 is formed with a cutting face 41' adapted to cause the cable 2 supported in position by the guide slit 52 in the guide bar 5 to be sheared by the shearing force which is produced by slidably moving the pressure connecting rod 14 along the slide surface 51 of the guide bar 5. To be exact, the cable 2 is sheared by means of the cutting face 41' in conjunction with the cutting face 52' formed inside the guide slit 52 of the guide bar 5. It is therefore desirable that the pressure connecting rod 4 and the guide bar 5 having the cutting faces 41 and 52' be fabricated of a carefully selected material and to subject them to heat treatment in order to enjoy prolonged use.

Figure 3:
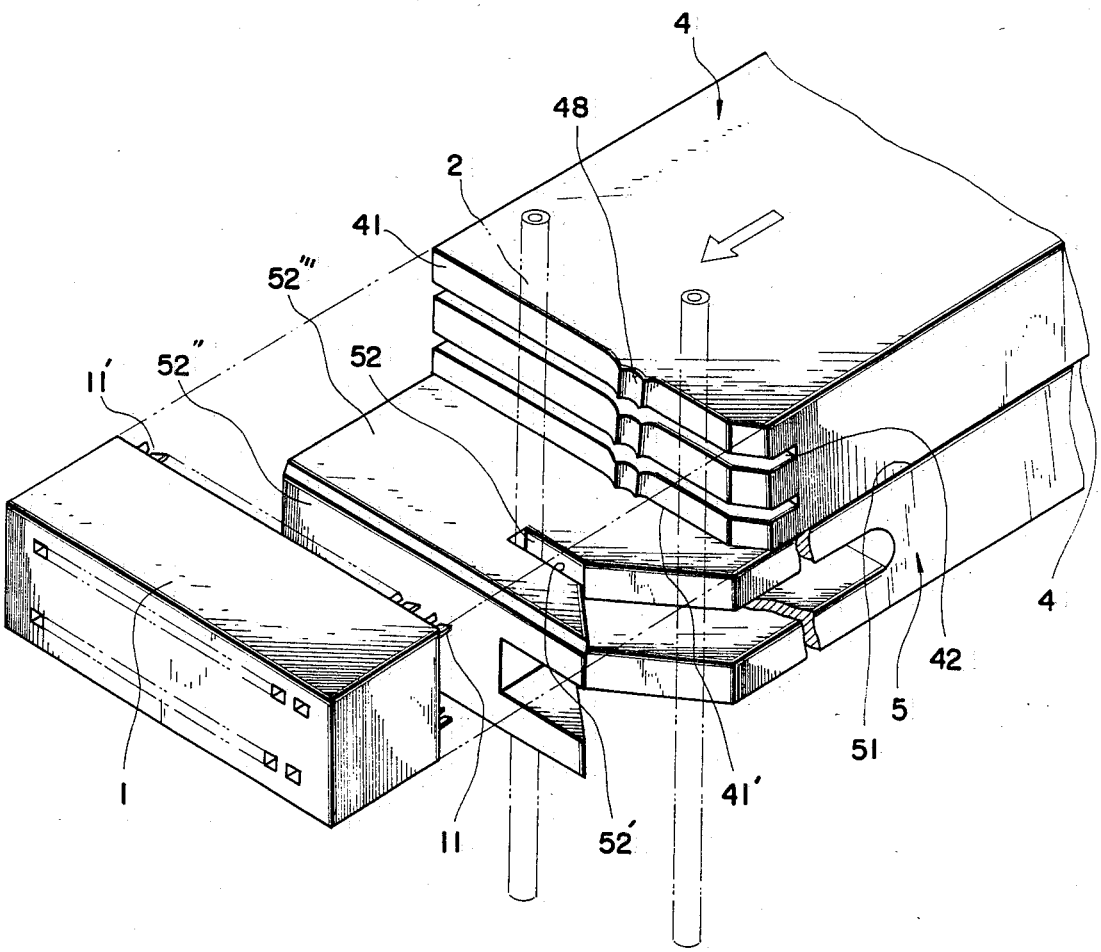
FIG. 3 is a perspective view illustrating the relationships among the pressure connecting rod, the guide bar and the connector.

As illustrated clearly in FIG. 3, in the front portion 52''' of the slide surface 51 of the guide bar 5 is formed the guide slit 52 which is adapted to guide and hold the cable 2 in front of the front end surface 41 of the pressure connecting rod 4 in a state intersecting the slide surface 51 formed with the cutting face 52'. To securely hold the cable 2 inside the guide slit 52, a keep lever "A" 56 is disposed above the guide slit 52 on the opening side of the guide slit, and a keep lever "B" 56' is disposed in the middle portion within the guide bar 5. These keep levers 56 and 56' are operated by a cam 59, a cam follower 58 and a lever 57 and so designed that the cable 2 is pushed into the guide slit 52 before advancing the front end surface 41 of the pressure connecting rod 4 toward the guide slit 52. The pressure connecting rod 4 is operated to move forward and backward by the driving means 6. The forward and backward movement of the pressure connecting rod is performed within a distance from the initial position at which the front end surface 41 of the rod 4 is placed behind the guide slit 52 of the guide bar 5 and from which the guide rod 4 set to work, to the most advanced position at which the rod 4 effects shearing and forces the cable 2 into the pressure contact 11 of the connector 1 to complete electrical continuity. After the pressure connecting rod 4 reaches the aforementioned most advanced position, then it is moved backward to the initial position by the force of the pulling spring 47. A plurality of electric cables are fixedly connected one by one to the pressure contacts 11 of the connector 1 by repeating the aforementioned procedure. The desired cable-connecting work is accomplished by means of the cam follower 45 mounted on the push member 4' communicating with the pressure connecting rod 4 and the driving means 6. The driving means 6 is composed of an electric motor 61 which serves as a power source, and toothed wheels 62 and 63 through which rotary motion produced by the motor 61 is transmitted to a shaft 65 provided with the cam 64. Additionally, the motor 61 has a function of rotating a cam 59 for operating the keep levers 56 and 56' disposed near by the side opening of the guide slit 52. The pulling spring 47 serves as a means for moving the pressure connecting rod 4 backward and is attached at one end portion to the bolt 46 fixed on the push member 4 and at the other end portion to the bolt 71 mounted on the rear wall.

The pressure connecting rod 4 and the guide bar 5 together are movable laterally (in the direction of the arrow indicated in FIG. 2), so that the cable supporting groove 48 formed in the front end portion of the pressure connecting rod 4 and the guide slit 52 formed in the guide bar 5 can freely be moved to the desired position opposite to the corresponding pressure contact 11 provided on the connector 1.

The lateral movement of the pressure connecting rod 4 and the guide bar 5 is carried out by hand or by using a suitable control device (not illustrated).

Now, the procedure involved in carrying out the pressure connection of the cable to the connector by use of the pressure connection device having the aforementioned construction according to the present invention will be described with reference to FIG. 1 through FIG. 4.

(1) First, the connector 1 for pressure connection is secured in position by the holder 3.

(2) One cable to be connected is taken out from the bundle thereof held by the clamping means 7 and inserted into the guide slit 52 formed in the guide bar 5. At that time, the guide bar 5 and the pressure connecting rod 4 together are manually or automatically moved to and fixed at the position facing the corresponding pressure contact 11 of the connector 1.

(3) The motor 61 is set in motion by utilizing an automatic control switch such as an optical sensor or a manual control switch to rotate the cam 59, thereby operating the lever 57 and the keep levers 56 and 56' so as to hold the cable 2 within the guide slit. On the other hand, the driving motion of the motor 61 is transmitted to the cam 64 through the medium of the toothed wheels 62 and 63, so that the cam follower 45 being in engagement with the cam 64 is pushed forwardly.

(4) Consequently, the push member 4' and the pressure connecting rod 4 which are mutually connected to the cam follower 45 are moved forward together with the coupling member 5' and the guide bar 5 on which the energizing force of the compression spring 55 is exerted forwardly.

Figure 4A:
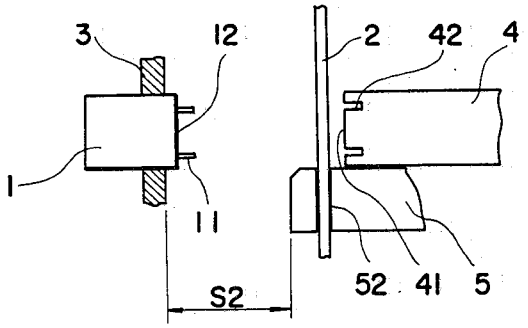
FIGS. 4(A) to 4(C) are explanatory views illustrating the pressure connecting procedure.
Figure 4B:
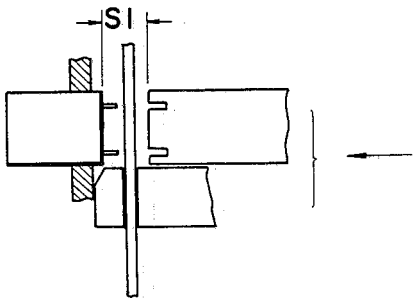
Figure 4C:
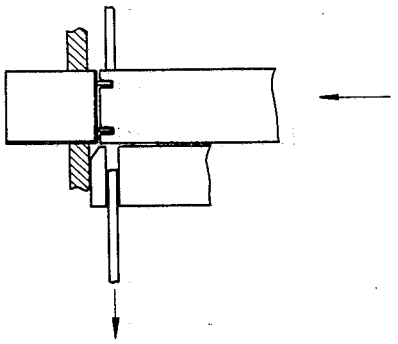

(5) When the front end surface 52'' of the guide bar 5 travels the distance $S_2$, it comes into contact with the holder 3 and is stopped (as illustrated in FIG. 4(B)), whereas the push member 4' and the pressure connecting rod 4 which are hitherto moved in concert with the coupling member 5' and the guide bar 5 are further moved forward with the continuous advance of the cam follower 45 against the energizing force produced by the compression spring 55.

(6) Subsequently, the front end portion 41 of the pressure connecting rod 4 comes into contact with the cable 2 supported by the guide slit 52 with the cable 2 being fitted in the cable supporting groove 48. Thereafter, the cable 2 is sheared by means of the cutting face 41' formed on the front end surface 41 of the pressure connecting rod 4 further advancing, in conjunction with the cutting face 52' formed inside the guide slit 52 of the guide bar 5. The unnecessary part cut off from the cable comes down to be removed.

(7) After shearing the cable 2, the front end surface 41 of the pressure connecting rod 4 is further moved forward until reaching the most advanced position separated from the initial standby position by a distance $S_1$, with the result that the cable 2 in a state held in the cable supporting groove 48 is squeezed into the pressure contact 11 of the connector 1 to establish an electrical connection. At this time, the cam 64 extends to the maximum in radius and the cam follower 45, the push member 4' and the pressure connecting rod 4 are placed in the most advanced positions thereof. As a result, the space $S_1'$ between the stepped portion 43 and the restricting surface 53 becomes the minimum.

(8) Upon completing electrical continuity between the cable and the contact of the connector, the cam 64 returns back, while rotating, to the minimum extent in radius, and at the same time, the cam follower 45, the push member 4' and the pressure connecting rod 4 are drawn back to the initial standby position by the force of the pulling spring 47, with the result that the coupling member 5' and the guide bar 5 which are moved in conjunction with the pressure connecting rod 4 are simultaneously drawn back to the initial position. Thus, all the components of this device are returned to the initial position in preparation for subsequent connection work. The above procedure is repeatedly carried out so as to establish pressure connection for a multiterminal connector.

Since the working speed of the cable connection according to the aforementioned procedure depends upon the revolving speed of the motor, instantaneous cable connection can be accomplished by utilizing a high speed motor.

When change of the shearing position of the cable 2 is required, the slide surface 51 of the guide bar 5 can be changed in height in relation to the connector 1. To be more specific, the pressure connecting rod 4 is fixed by the bolt 44 attached to the housing 7 and also, the guide bar 5 is fixed by the bolt 54 so that they can readily be detached. Therefore, if the pressure connecting rods 4 and the guide bars 5 of various sizes are prepared, the height of the slide surface 51 can be changed by selectively combining them, or otherwise, the shearing position of the cable can be changed by replacing either the holder 3 or the housing 7.

Figure 5:
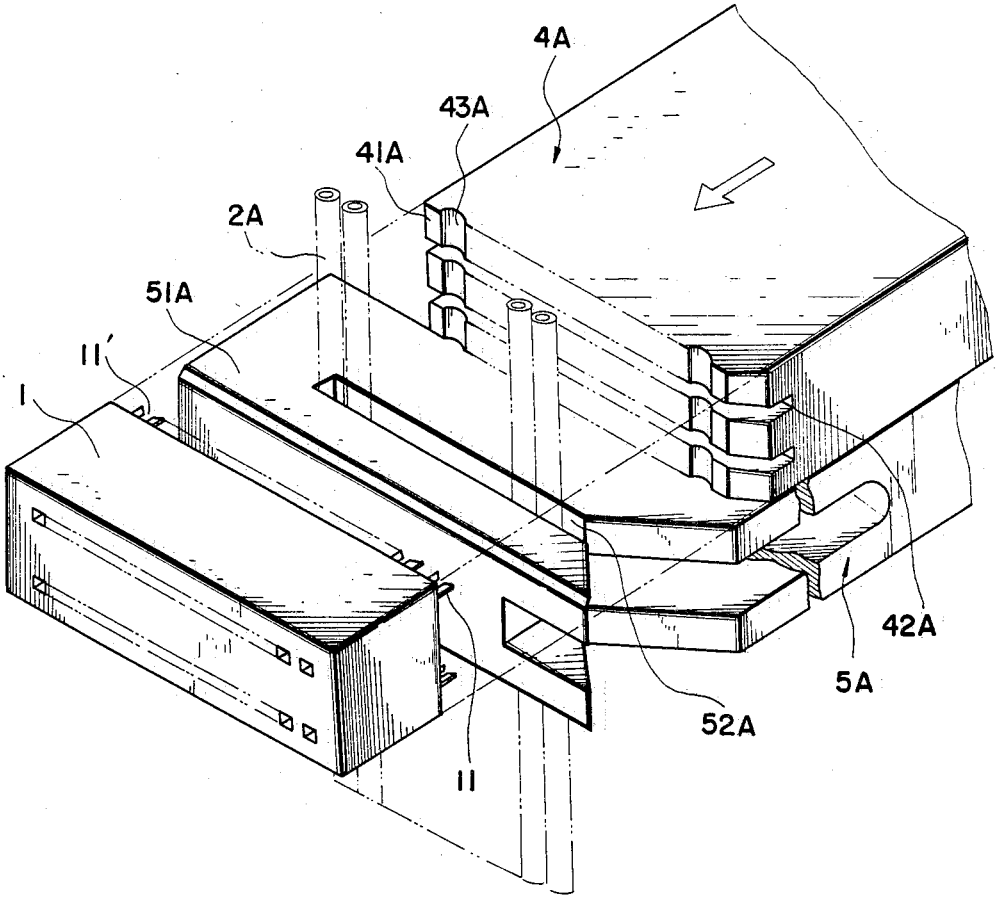
FIG. 5 is a perspective view of another embodiment according to the present invention.
Figure 6:
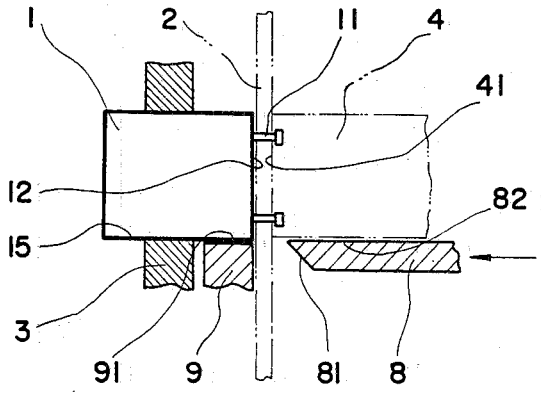
FIG. 6 is an explanatory view illustrating in part a conventional pressure connection device.

Next, another embodiment representing a case where a streamlined cable 2A composed of a plurality of electric wires is applied will be described with reference to FIG. 5 wherein like parts are designated by the same numerals as in FIGS. 1 to 4.

The guide slit 52A formed in the front portion 51A of the guide bar 5A has relatively long length to hold in position the streamlined cable 2A. In the front end surface 41A of the pressure connecting rod 4A are formed escape recesses 42A for receiving the pressure contacts 11 fixed on the connector and a plurality of cable supporting grooves 43A corresponding to the several wires of the streamlined cable 2A.

The procedure of pressure connection for the cable by use of the pressure connection device thus constructed is carried out similarly to that in the former embodiment and therefore, the explanation thereabout is not made here.

The pressure connection device having the aforementioned construction and function has an outstanding advantage described below.

(1) Because provision of a cutter rest is unnecessary, the cutting faces 41' and 52' serving to shear the cable 2 are little worn and the cutting quality thereof is not soon deteriorated and therefore, troublesome replacement and polishing of the pressure connecting rod 4 and the guide bar 5 are not frequently required, thereby to eliminate the various drawbacks suffered by the conventional pressure connection device. Besides, the cable 2 is effectively sheared by the incisive cutting faces 41' and 52' which endure hard use and enjoy improved properties such as prolonged service life.

(2) The pressure connecting rod 4 and the guide bar 5 are fitted into and secured on the housing 7 by means of the bolts 44 and 54 so as to facilitate the fixation and detachment thereof. As a result, the work of adjusting the shearing position of the cable 2, which has hitherto required much time and labor and proved to be troublesome, can easily be accomplished by selectively combining various pressure connecting rods and guide bars of different sizes so as to make it possible to cope with a connector of a different kind with ease.

(3) Because the shearing position of the cable 2 can be freely changed as described above and furthermore, the sheared end of the cable 2 held by the pressure contact 11 does not protrude from the side surface 15 of the connector 1, a suitable cover can be fitted on the side 12 to completely cover the sheared end of the cable, thereby allowing the connector being connected to the cable to be safely used without sustaining injuries to the fingers of the user.

(4) The unnecessary length of the cable 2 is sheared off and removed prior to bringing it into contact with the pressure contact of the connector. Accordingly, there is no possibility of causing incomplete connection of the cable with the contact of the connector, which has been often caused by shearing the cable which is in contact with the contact. Even when the shearing portion of the cable is close by the contact such as in a small-sized connector, complete pressure connection of the cable with the contact can be accomplished.

What is claimed is:

1. A pressure connection device for a connector, comprising a holder for retaining in position a connector having a plurality of contacts, a guide bar for guiding and supporting at least one cable in preparation for pressure connection, and a pressure connecting rod adapted to force the cable into the corresponding contact of the connector, means for driving said pressure connecting rod, said guide bar being formed with a guide slit for guiding and supporting the cable, said pressure connecting rod being capable of moving in forward and backward directions and having a slide surface, means holding said slide surface continually in sliding contact with said guide bar, said pressure connecting rod having a front end surface serving as a cutting face adapted to shear the cable in conjunction with an edge of the guide slit of the guide bar, the front end surface of the pressure connecting rod being located behind the guide slit of said guide bar at an initial position, and after the front end surface of said pressure connecting rod is moved forward by said driving means coming into contact with and then shearing the cable by relative motion between said connecting rod and said guide bar, said pressure connecting rod is further moved forward to permit the cable to be forced into said pressure contact, to thereby establish an electrical connection and thereafter, the front end surface is returned to the initial position, said front end surface of said pressure connecting rod having escape recesses for accommodating the pressure contacts on said connector and at least one cable supporting groove for supporting said cable, and at least one keep lever adapted to push the cable into said guide slit formed in said guide bar and retain the cable in position until pressure connection of the cable to the contact of the connector is completed.

2. A pressure connection device according to claim 1, wherein said pressure connecting rod and said guide bar are fixedly contained within a housing in a state detachable from the housing.

3. A pressure connection device according to claim 1, wherein said pressure connecting rod and said guide bar are fixedly contained within a housing in a state detachable from the housing.

4. A pressure connection device according to claim 2, further comprising at least one keep lever which is adapted to push the cable into said guide slit formed in said guide bar and retain the cable in position until pressure connection of the cable to the contact of the connector is completed.

5. A pressure connection device according to claim 3, further comprising at least one keep lever which is adapted to push the cable into said guide slit formed in said guide bar and retain the cable in position until pressure connection of the cable to the contact of the connector is completed.

6. A pressure connection device according to claim 1, wherein the depth direction of said guide slit extends transversely to said forward and backward directions of said pressure connecting rod.

7. A pressure connection device for a connector, comprising a holder for retaining in position a connector having a plurality of contacts, a guide bar for guiding and supporting at least one cable in preparation for pressure connection, and a pressure connecting rod adapted to force the cable into the corresponding contact of the connector, means for driving said pressure connecting rod, said guide bar being formed with a guide slit for guiding and supporting the cable, said pressure connecting rod being capable of moving in forward and backward directions and having a slide surface coming into slidable contact with said guide bar, said pressure connecting rod having a front end surface serving as a cutting face adapted to shear the cable in conjunction with an edge of the guide slit of the guide bar, the front end surface of the pressure connecting rod being located behind the guide slit of said guide bar at an initial position, and after the front end surface of said pressure connecting rod is moved forward by said driving means coming into contact with and then shearing the cable by relative motion between said connecting rod and said guide bar, said pressure connecting rod is further moved forward to permit the cable to be forced into said pressure contact, to thereby establish an electrical connection and thereafter, the front end surface is returned to the initial position, said driving means mounted to move said pressure connecting rod and said guide bar together forward from the initial position to contact the holder with said guide bar and then stop the guide bar when it comes into contact with said holder, whereas said pressure connecting rod is further moved forward to shear and force the cable into the contact of said connector, said driving means being further arranged to thereafter return said pressure connecting rod and said guide bar together back to the initial position by means of a reversing means.

8. A pressure connection device according to claim 7, wherein the front end surface of said pressure connecting rod is possessed of escape recesses for accommodating the pressure contacts provided on the connector and at least one cable supporting groove for supporting the cable.

9. A pressure connection device according to claim 7, wherein said pressure connecting rod and said guide bar are fixedly contained within a housing in a state detachable from the housing.

10. A pressure connection device according to claim 8, wherein said pressure connecting rod and said guide bar are fixedly contained within a housing in a state detachable from the housing.

11. A pressure connection device according to claim 8, further comprising at least one keep lever which is adapted to push the cable into said guide slit formed in said guide bar and retain the cable in position until pressure connection of the cable to the contact of the connector is completed.

12. A pressure connection device according to claim 9, further comprising at least one keep lever which is adapted to push the cable into said guide slit formed in said guide bar and retain the cable in position until pressure connection of the cable to the contact of the connector is completed.

13. A pressure connection device according to claim 10, further comprising at least one keep lever which is adapted to push the cable into said guide slit formed in said guide bar and retain the cable in position until pressure connection of the cable to the contact of the connector is completed.

14. A pressure connection device for a connector, comprising a holder for retaining in position a connector having a plurality of contacts, a guide bar for guiding and supporting at least one cable in preparation for pressure connection, and a pressure connecting rod adapted to force the cable into the corresponding contact of the connector, means for driving said pressure connecting rod, said guide bar being formed with a guide slit for guiding and supporting the cable, said pressure connecting rod being capable of moving in forward and backward directions and having a slide surface coming into slidable contact with said guide bar, said pressure connecting rod having a front end surface serving as a cutting face adapted to shear the cable in conjunction with an edge of the guide slit of the guide bar, the front end surface of the pressure connecting rod being located behind the guide slit of said guide bar at an initial position, and after the front end surface of said pressure connecting rod is moved forward by said driving means coming into contact with and then shearing the cable by relative motion between said connecting rod and said guide bar, said pressure connecting rod is further moved forward to permit the cable to be forced into said pressure contact, to thereby establish an electrical connection and thereafter, the front end surface is returned to the initial position, said pressure connecting rod and guide bar further being mounted to move transversely of said forward direction, said driving means comprising means moving said pressure rod and guide bar in said transverse direction to engage said cable in said slit.

15. A pressure connection device for a connector, comprising a holder for retaining in position a connector having a plurality of contacts, a guide bar for guiding and supporting at least one cable in preparation for pressure connection, and a pressure connecting rod adapted to force the cable into the corresponding contact of the connector, means for driving said pressure connecting rod, said guide bar being formed with a guide slit for guiding and supporting the cable, said pressure connecting rod being capable of moving in forward and backward directions and having a slide surface coming into slidable contact with said guide bar, said pressure connecting rod having a front end surface serving as a cutting face adapted to shear the cable in conjunction with an edge of the guide slit of the guide bar, the front end surface of the pressure connecting rod being located behind the guide slit of said guide bar at an initial position, and after the front end surface of said pressure connecting rod is moved forward by said driving means coming into contact with and then shearing the cable by relative motion between said connecting rod and said guide bar, said pressure connecting rod is further moved forward to permit the cable to be forced into said pressure contact, to thereby establish an electrical connection and thereafter, the front end surface is returned to the initial position, and means relaseably holding said cable in said guide slit, said guide bar being movable in said forward and backward directions independently of said pressure contacting rod to enable stopping of said guide bar at a determined position prior to said shearing of the cable, said driving means separately controlling movements of said guide bar in said forward and backward directions and the holding of said cable by said releasable holding means.

* * * * *